US006008443A

United States Patent [19]

Honorato Ibañez

[11] Patent Number: 6,008,443

[45] Date of Patent: Dec. 28, 1999

[54] ENHANCEMENTS INTRODUCED INTO BRASS INSTRUMENTS AND METHOD FOR THE MANUFACTURING OF PARTS FOR SUCH INSTRUMENTS

[75] Inventor: Vicente Honorato Ibañez, Mislata, Spain

[73] Assignee: Honiba, S.A., Mislata, Spain

[21] Appl. No.: 08/513,824

[22] PCT Filed: Jan. 10, 1995

[86] PCT No.: PCT/ES95/00005

§ 371 Date: Sep. 1, 1995

§ 102(e) Date: Sep. 1, 1995

[87] PCT Pub. No.: WO95/19032

PCT Pub. Date: Jul. 13, 1995

[30] Foreign Application Priority Data

| | | | |
|---|---|---|---|
| Jan. 10, 1994 | [ES] | Spain | 9400029 |
| Jan. 10, 1994 | [ES] | Spain | 9400030 |
| May 23, 1994 | [ES] | Spain | 9401127 |
| May 18, 1994 | [ES] | Spain | 9401090 |

[51] Int. Cl.[6] ..... G10D 7/10

[52] U.S. Cl. ..... 84/387 R; 84/394; 84/396

[58] Field of Search ..... 84/387 R, 394, 84/396

[56] References Cited

U.S. PATENT DOCUMENTS

| | | | |
|---|---|---|---|
| 3,807,271 | 4/1974 | Nipken | 84/399 |
| 4,276,804 | 7/1981 | Hollard | 84/394 |

FOREIGN PATENT DOCUMENTS

| | | |
|---|---|---|
| 377074 | 8/1922 | Germany . |
| 3914591 | 8/1990 | Germany . |
| 1268379 | 3/1972 | United Kingdom . |
| 8002885 | 12/1980 | WIPO . |

*Primary Examiner*—William M. Shoop, Jr.
*Assistant Examiner*—Kim Lockett
*Attorney, Agent, or Firm*—Ladas & Parry

[57] ABSTRACT

A brass instrument having a mouthpiece connected by a pipe to a valved body which is in turn connected to an output bending and a bell thereby defining an air duct. The bell and the output bending are formed of separate and detachable parts. The brass instrument has an intermediate section between the output bending and the bell and a coupling member for detachably coupling the intermediate section to the output bending and to the bell respectively. The intermediate section has a plurality of subsections in telescopic relation to one another and parts for adjusting an overlap between the plurality of telescopic subsections so as to change a length of the intermediate section whereby to alter a tone of the instrument.

5 Claims, 6 Drawing Sheets

ENHANCEMENTS INTRODUCED INTO BRASS INSTRUMENTS AND METHOD FOR THE MANUFACTURING OF PARTS FOR SUCH INSTRUMENTS

OBJECT OF THE INVENTION

This invention refers to a series of enhancements introduced in brass instruments, especially in trumpets. Such enhancements are focused on the tuning system and the characteristics of the mouthpiece itself, and they can be applied to other brass instruments, such as french horns, tubas, trombones, tenor horns and similar instruments.

The invention also refers to a procedure for the manufacturing of some hollow parts which form part of the brass instrument itself such as the bell, the bendings, etc.

Both the enhancements introduced in the tuning system and in the manufacturing of the mouthpiece and, obviously, the way to obtain certain hollow elements of the instrument, which is preferably a trumpet, in order to achieve tuning enhancements and, obviously, a cheapening in the manufacturing process.

BACKGROUND OF THE INVENTION

The general procedure normally used to tune a trumpet consists of a variation of the length of the so-called "flue pipe". Such variation is achieved by means of extensible sections which enable a longer flue pipe.

Obviously, since the tonality of a trumpet depends on the length of the flue pipe, in order to achieve different notes of the musical scale it is necessary to enlarge or shorten the length of such flue pipe, thereby modifying the route of the air flow and providing the instrument the necessary distance to obtain a frequency which determines its proper general tuning.

Up to now, trumpet manufacturers based the tuning of the instrument on a part known as "tudel", formed by a series of extensible pipes known as "general pump", which can be lengthened to tune the trumpet. Such "tudel" is a part located before the so-called instrument "body". Therefore, the tuning section of trumpets is located before the so-called trumpet body.

When the musical instrument does not enable its tuning at the tudel, due to its length, the manufacturer has either to lengthen such tudel, as in the case of the Piccolo trumpet or to lengthen the bell itself, previously denominated flue pipe. Such lengthening is performed at the end of the body. This tuning procedure is normally applied to the so called B-Cb trumpet.

In summary, trumpets can be tuned either at the mouth side or "tudel" section, at the "general pump" section, which is the bend located before the body, before the tudel itself, or even at the bell section located after the instrument body. This section is formed by a single piece comprising the bell and the relevant output bending.

When the tuning is to be performed after the trumpet body, it is necessary to replace such bell, i.e., the section comprising the output bending and the relevant bell.

On the other hand, and as far as the structure of the instrument is concerned, in the case of trumpets and similar instruments, they are formed by different properly assembled metal parts. Sometimes, such parts are of a cylindrical shape, with or without curved sections, normally, semi-circumferential, although they can also present a trunco-conical shape with a curved generative, as it is the case of the bell.

In any case, a metal pipe or plate is used to obtain such pieces. They are conveniently shaped by means of a deformation either through a hot- or cold- process. These pieces are usually moulded, either manually, by means of hammers or any other adequate tool, or mechanically, by means of hydraulically- or mechanically operated shaping machines.

Obviously, and since most pieces are generated ones, the use of plates increases the complexity of the operation, especially when they have to be closed. Therefore, it is more appropriate—in principle—to use pipes. However, they also present—especially when manufacturing bells—the problem derived from the difference in diameters, and therefore, they usually different wall thicknesses, with an excessive thickness on the end with larger diameter and an insignificant thickness at the other end.

Another fact to be taken into consideration is that mouthpieces used by brass instruments are normally formed by a single piece split into three different parts, the "output cone", which is directly attached to the instrument, and more specifically, to the section known as tudel. Therefore, such output cone can have different inner dimensions, depending on the needs of the musician. The second part of the mouthpiece is the so-called "bowl", which determines a cavity to collect vibrations produced by the lips of the musician. Such bowl, depending on the characteristics of the musician and the type of music being played, will have a larger or smaller size, with different accepted shapes and deepness. The third part is formed by the so-called mouthpiece "ring" or "edge", which is the element coming into contact with the lips of the musician. This part is considered to be very critical, due to the preferences of the musician, as far as the shape of the rings is concerned.

The three elements forming the mouthpiece of a brass instrument are normally formed by a single piece, which, in some instances can have a detachable edge or ring. Therefore, neither the bowl nor the output cone can be varied and the musician will have to purchase a complete set each time he wishes to use a specific mouthpiece, without the possibility of replacing them by others more suitable to his specific needs or preferences.

DESCRIPTION OF THE INVENTION

The enhancements which are the object of this invention solve the problems mentioned above, by implementing a series of simple and useful solutions.

The first enhancement consists of a tuning system of the instrument, so that such tuning device is located after the body, without the need for bell replacement.

More specifically, the first novelty of the invention consists of the fact that the tuning is not performed at the so-called tudel, as it has been traditionally done, but after the so-called "body" of the instrument. Therefore, it incorporates, after such body, the section known as "general pump", which forms part of the bell, although it can be detached so that the tuning process can be performed by changing the output bending. This is achieved by the fact that the bell can be detached from the bending.

In summary, this system replaces the general pump of the tudel, incorporating the tuning device at the trumpet bell.

Therefore, in the so-called B-Cb trumpets, the only element to be exchanged is the output bending, known as general pump, to change the trumpet tuning to a Cb or B trumpet, instead of the whole bell, as previously.

Obviously, this system can be applied to any kid of trumpet, such as those known as Bb, C, D-Eb, F, G and Piccolo.

Another thing to be mentioned is the fact that tuning can be regulated by the bending formed by the detachable rear part and the bell, which is inserted between the bell and the trumpet body.

Obviously, the system enables to incorporate different types of bells with the same bending, i.e., the bell can be exchanged by changing the bell itself, instead of the whole device, as it has been traditionally done.

As an alternative execution of the invention, the tuning system is based on the fact that the bell and the relevant previous bending are telescopically coupled to gradually lengthen the flue pipe (which, as previously mentioned, is formed by the bell itself) to achieve the exact length of the instrument for a perfect tuning, note to note. The telescopic lengthening of the above-mentioned parts is achieved by means of a rod threaded on the trumped body, which incorporates a manually-operated knob at one end and an element which pushes the telescopic coupling, thereby enabling to lengthen or shorten such coupling—and thereby, the bell or flue pipe formed by the bending or the bell—, with the help of an expansion spring.

According to this second tuning system, it is also possible to independently tune the instrument, note by note, by means of an axial motion of the rod, which lengthens or shortens the length of the instrument bell.

Another enhancement of the invention refers to the mouthpiece of the brass instrument, which is formed so that the three core pieces are formed by independent elements or pieces properly coupled and detachable, so that any of them can be replaced maintaining the other two or viceversa, i.e., to replace two of them maintaining the third one. This fact entails considerable savings and the possibility of using at a given moment, the element better suited to the characteristics of the musician, etc.

More specifically, the mouthpiece, according to one of the enhancements of the invention, incorporates an output cone as an independent element of the relevant bowl and this latter as an independent element from the edge or ring, with the peculiarity that the output cone incorporates at the front end a cavity forming a bowl, with an inverted trunco-conical shape to be adapted to the different bowl sizes, since these latter ones will have a matching outer shape. The edge or ring can also be detached from these two elements, to enable the user the capacity to replace it by another one with the characteristics desired.

Therefore, the musician, by using a single ring and cone may vary the depth of the bowl, which is the element that determines the subsequent sonority of the instrument, and which in any case may have the depth preferred by the musician. Therefore, any specific mouthpiece can be attached to different bowls, maintaining the two remaining elements, with the subsequent savings and the advantage that the musician will not perceive that the bowl has been changed.

Finally, another enhancement of the invention consists of the production of specific elements of the musical instrument herein described. The procedure is based on a first operating stage that consists of a continuous or discontinuous metallic filament, depending on the specific needs, and which is helically rolled around a mould, thereby forming the base for the relevant element.

Subsequently, the filamented element thus obtained is finally shaped by means of one of the following alternatives, i.e., by means of heat, pressure, welding or any other technique, or by means of electrolytic plating where the filamented element is introduced into a dip and receives a metallic layer which enhances the base body and connects the spires forming the body.

DESCRIPTION OF THE DRAWINGS

To complement this description and in an effort to better understand the main characteristics of the invention, a set of drawings is attached to this descriptive report forming an integral part of it and where, as an illustration and without limitation, the following has been represented.

Finally.

PREFERRED EMBODIMENT OF THE INVENTION

Figure 1:
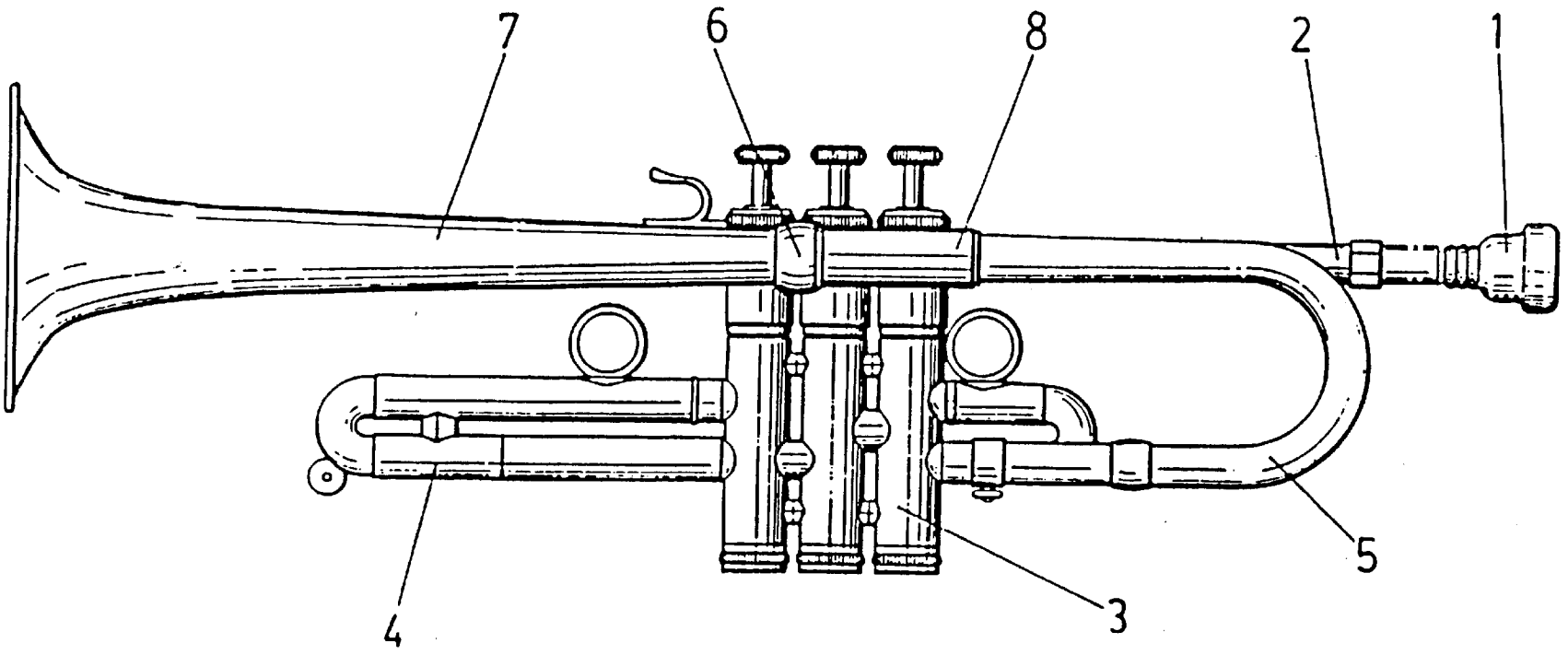
FIG. 1 shows a representation of a side view of a Cb-B trumpet incorporating the tuning system which is the object of this invention.
Figure 2:
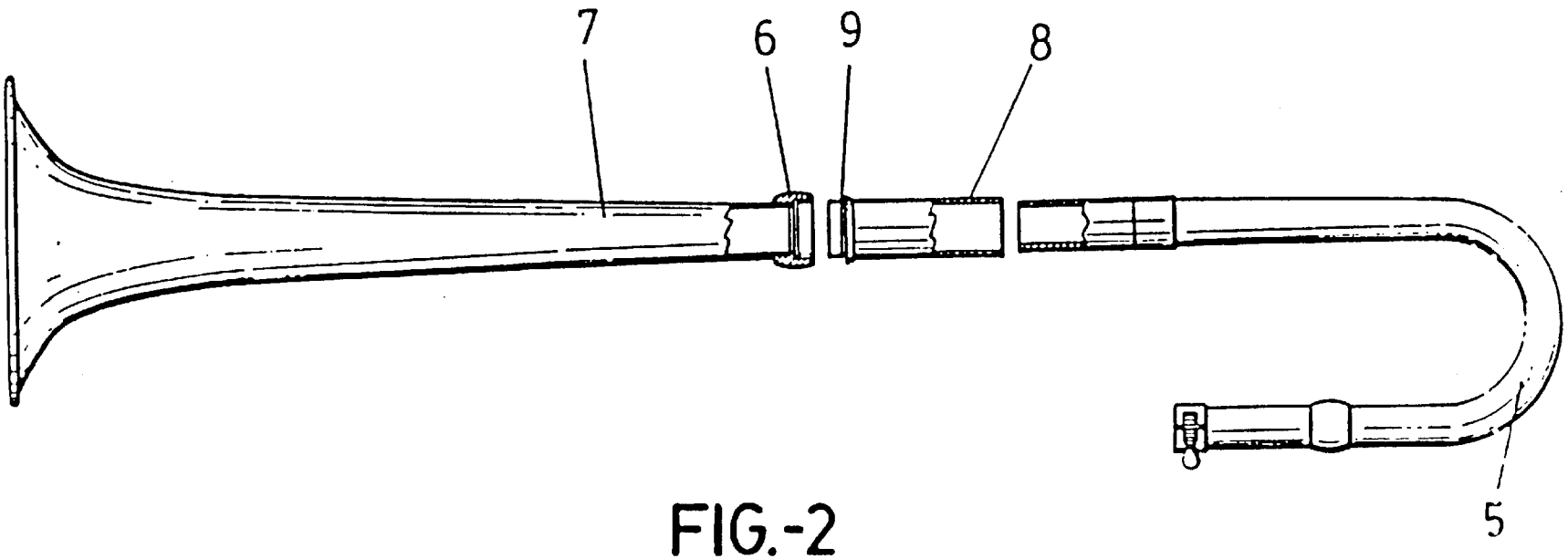
FIG. 2 shows a detail of the bell based on the tuning system of the previous figure.

The figures, and more specifically, FIGS. 1 and 2, show a trumpet incorporating a tuning system carried out in accordance with the first embodiment, where the trumpet incorporates a mouthpiece (1) coupled to the relevant pipe (2) reaching the so-called trumpet body (3) where the air flows through the input bending (4) to the so-called bell that, in the execution of the system of the invention, incorporates a bending (5) to perform the tuning, and a bell (7) attached to this latter by means of the proper coupling device (6).

This means that, while in conventional trumpets the bell is formed by a bell (7) and the output bending (5) forming a single body, the trumpet to which this invention refers is formed by two independent parts which can be coupled together, so that the tuning will be performed after the trumpet body (3), instead of performing it before the body, as it was traditionally being done.

The bending (5) forming the tuning pump, as it has been previously indicated, is telescopically coupled to a section (8) which is, in turn, coupled through the section (6) to the end of the bell (7), as it can be clearly seen in FIG. 2, where the intermediate coupling section (8) incorporates at the connecting end of the section (6) associated to the end of the bell (7) a ring-shaped recess (9) acting as a stop of the end of the section (8) on the cavity defined by the coupling section (8) at that end.

Therefore, in accordance with the system depicted in FIGS. 1 and 2, the bending (5), through such coupling, can be lengthened or shortened with respect to the bell (7) thereby achieving the proper tuning without the need for replacing the whole assembly. It suffices to replace the above-mentioned output bending (5) forming the tuning pump and keep the bell, thereby obtaining an adjustable tuning.

In summary, the tuning of the trumpet, according to the first enhancement which is the object of this invention, is performed after the trumpet body (3), i.e. at the bell itself, instead of performing it before the trumpet body (3) as traditionally, with the advantages pointed out in this descriptive report, since the tuning only calls for the replacement of the output bending (5) located between the trumpet body (3) and the bell (7).

Obviously, the coupling of the elements should be perfect, so that the air expelled during the performance of a given musical note is completely used, without the possibility of leaks.

Figure 3:
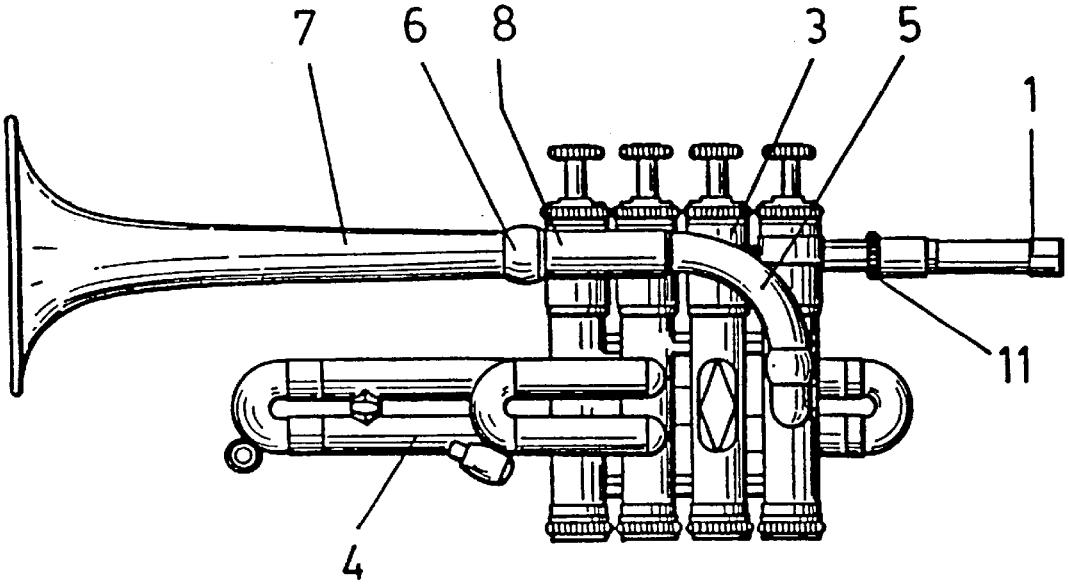
FIG. 3 shows a general representation of a trumpet incorporating the telescopic tuning system, in accordance with the enhancements postulated in this invention.
Figure 4:
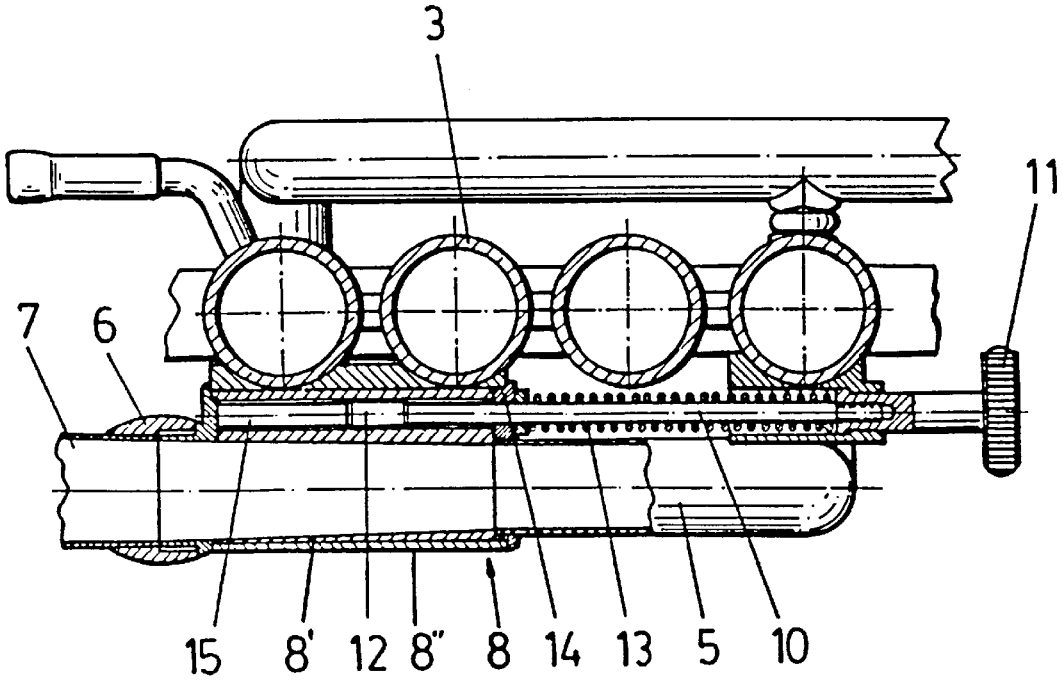
FIG. 4 shows a detailed view of the trumpet body and the telescopic coupling depicted in the previous figure, with the actuating rod set at the minimum length position of the flue pipe.
Figure 5:
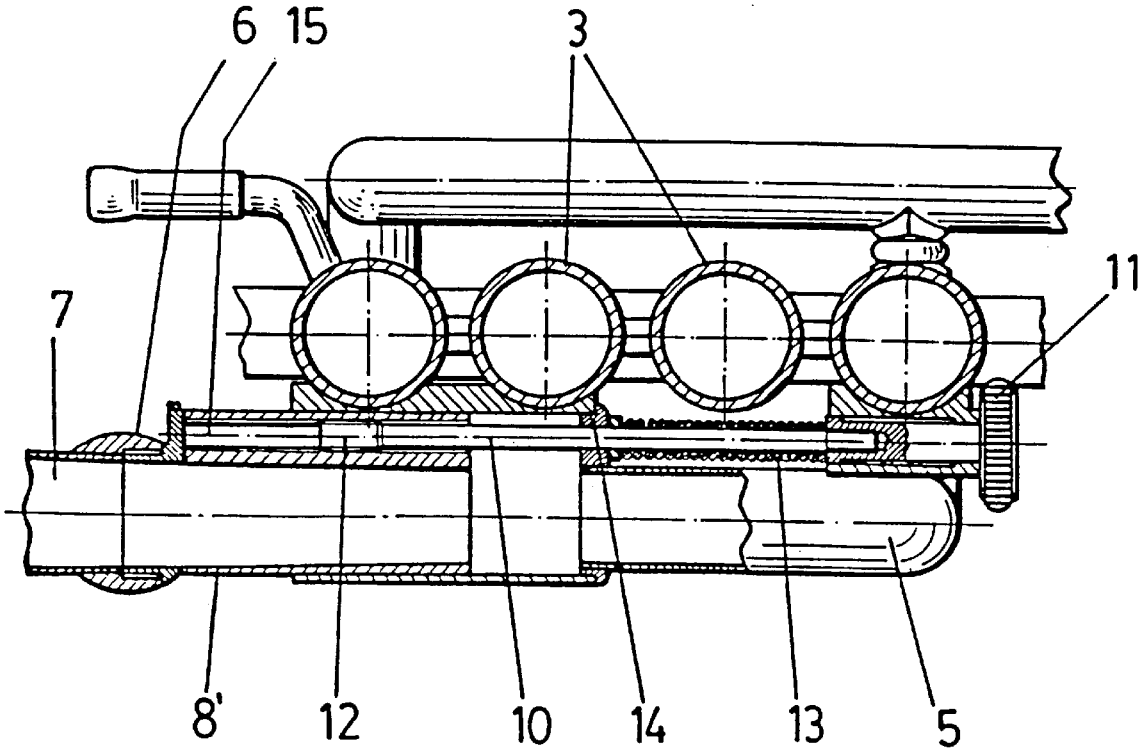
FIG. 5 shows another detail similar to the one of the previous figure, where the actuating rod has been set at the maximum length of the trumpet bell.

FIGS. 3, 4 and 5 show an alternate tuning system. In this case, the trumpet body (3) incorporates four valves, which correspond to four specific notes.

In this second embodiment, the section (8) is a telescopic section which can be actuated by lengthening or shortening it by means of a rod (10) ending on a manually operated key (11) on the outer side. Such rod (10) incorporates an outer threaded section actuating on the section (8') of the two sections forming the telescopic section (8) since the outer section is that marked as (8"). The section (8') is telescopically coupled to the outer section (8") so that when the latter is moved, the bell (7) will also be moved, thereby lengthening or shortening the flue pipe formed by such bell, depending on the direction of the motion.

The rod (10) is helped by a spring (13) located between the coupling end of the rod to the key (11) and the rear stop (14) of the telescopic coupling (8).

Therefore, the rotation of the rod (10) will enable, through the threaded section (12), to lengthen or shorten the overall length of the instrument, i.e. the length of the flue pipe or bell (7), thereby achieving the tuning of the instrument.

Furthermore, through the motion of the rod (10), the length of the bell (7) can be modified, thereby achieving a pipe with the exact length required for its proper tuning, note by note. Therefore, the general tuning will be corrected, irrespective of each note forming part of the scale of the trumpet or instrument.

Obviously, the bell (7) is detachable from the section (8) and therefore, from the output bending (5), with the previously mentioned coupling section (6) between the bell (7) and the relevant output bending (5), or telescopic section (8).

Finally, the rod (10) is threaded on a pipe (15) which forms part of the telescopic section previously mentioned.

Figure 6:
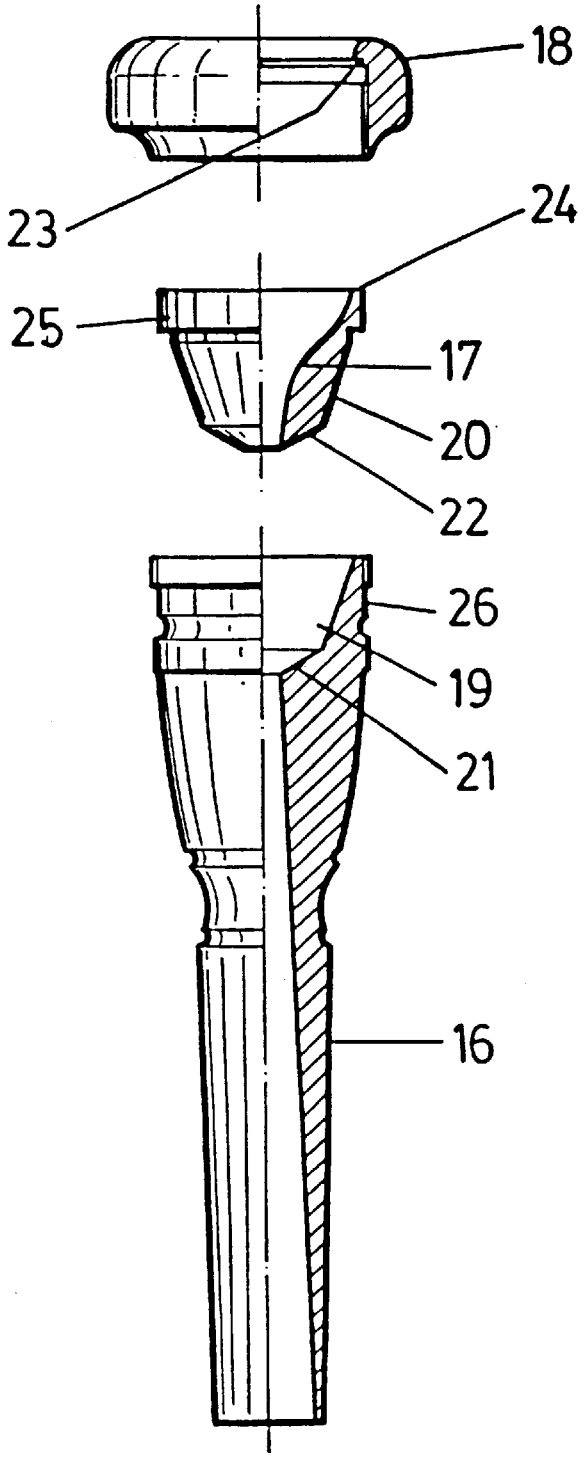
FIG. 6 shows a side breakdown (one fourth section) of the three independent parts forming the mouthpiece for brass instruments carried out in accordance with the enhancements postulated in this invention.
Figure 7:
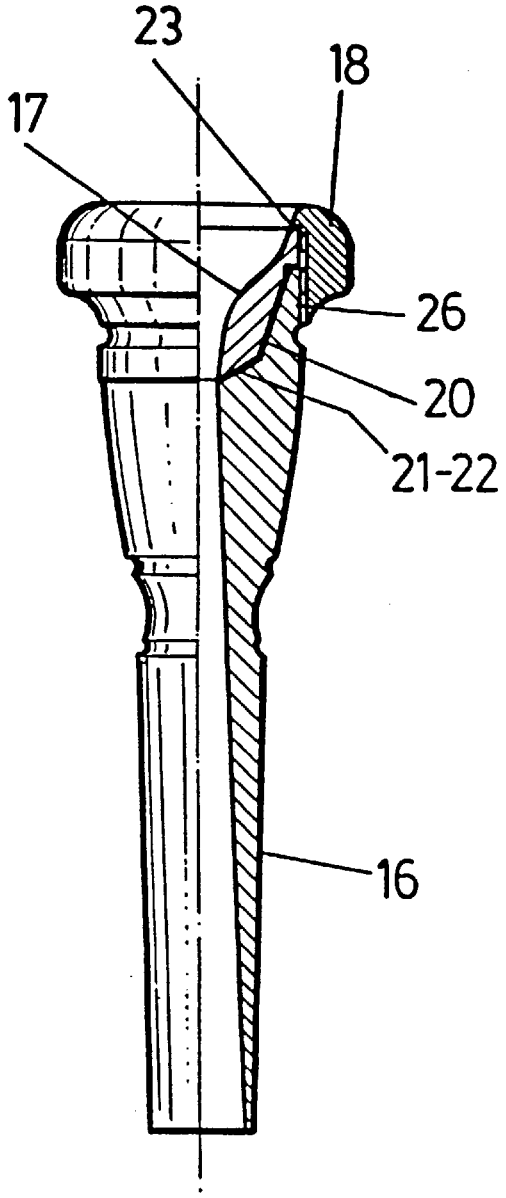
FIG. 7 shows a general view of the mouthpiece (one fourth section) with the three pieces properly coupled.

FIGS. 6 and 7 show the embodiment of the mouthpiece for musical instruments, in accordance with another enhancement which is the object of this invention. Such mouthpiece is formed by three independent sections or parts (16), (17) and (18). Part number 16 is the output cone (1) while part (17) is the bowl. Part (18) is the mouthpiece edge or ring.

The output cone (16) is a tubular part in accordance with FIG. 6, with the peculiarity that the front end incorporates an inner bowl (19) of an inverted trunco-conical shape to fit into the different bowl models (17). Each one of them incorporates a side surface (20) that matches the bowl (19) located at the end of the output cone (16).

It should be highlighted that the bottom (21) of (19) of the output cone (16) and the bottom part (22) of the bowl (17) present an sloped generative determining a section different to the one described above which matches it, at previously mentioned.

Therefore, due to the special shape or peculiarity of the bowl (19) of the output cone (16) and the subsequent shape of the different bowls (17) these latter ones can be coupled to the former, thereby obtaining a greater or lesser length, depending on the length of the bowl (17) to alter the resulting sound, preserving the ring or edge (18) and the output cone (16) itself. The ring (18) presents an internal recess (23) near its outer edge, that stops the relevant edge or end (24) of the bowl (17), therefore adjusting the ring (18) both to the side surface of the straight section (25) of the bowl and to the side surface (26) of the output cone itself, as it can be clearly seen in FIG. 7.

In accordance with the above-mentioned structure, the mouthpiece enables the musician to change any of the three pieces (16), (17) and (18) and keeping the rest in accordance with the requirements, characteristics and needs of the musician who sometimes needs to replace the ring or edge (18) by another one that fits his lips properly, or change the bowl itself (17) in some cases to modify the resulting sound, in accordance with the characteristics of the musician.

Figure 8:
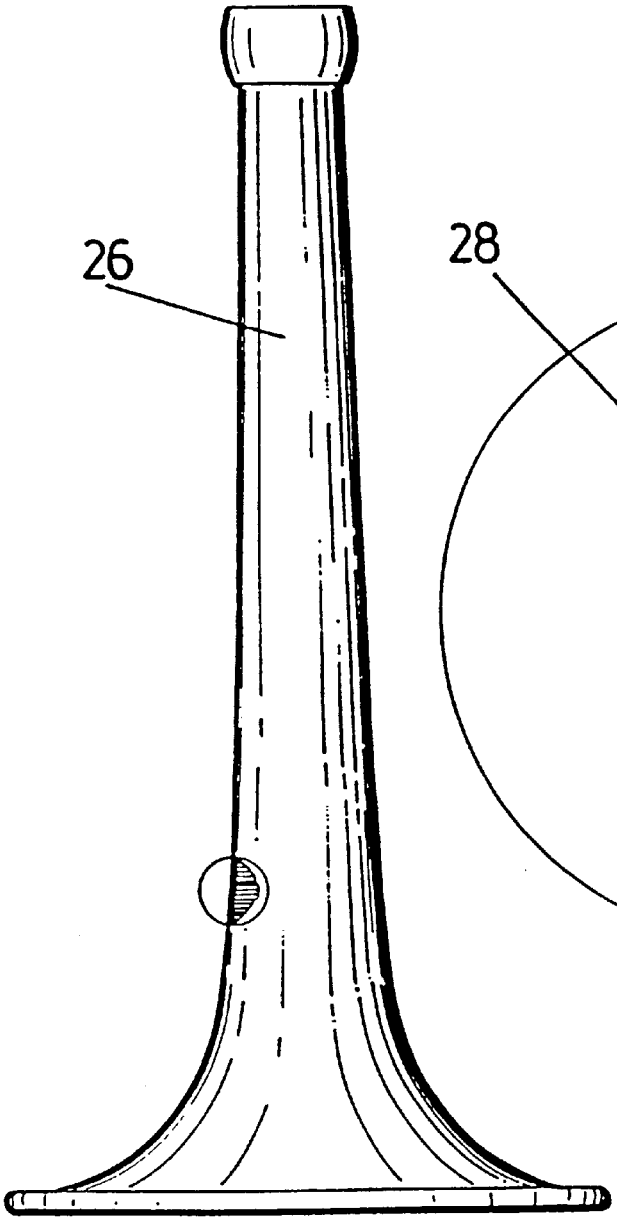
FIG. 8 shows a side schematic view of a music instrument, and more specifically, a bell obtained following a procedure which is another enhancement of the invention.
Figure 9:
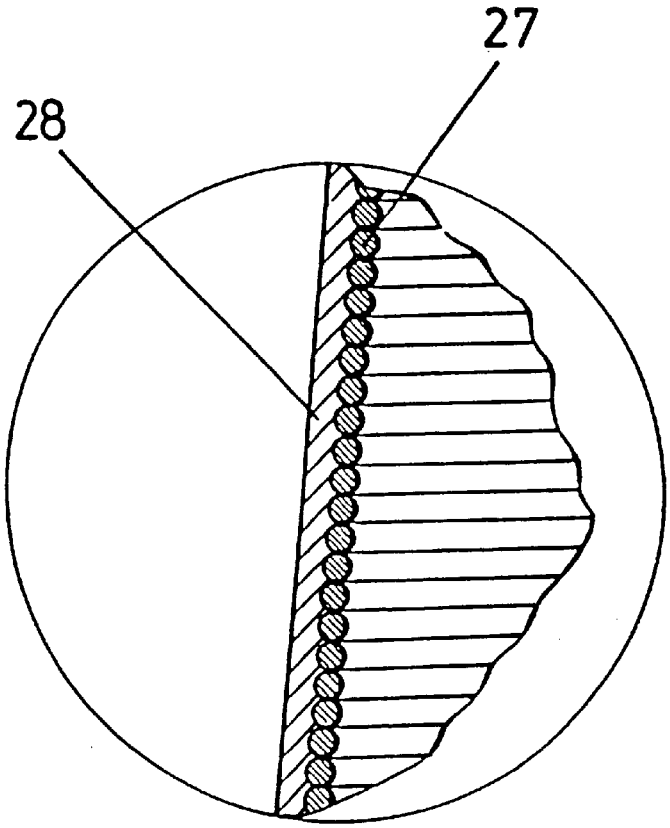
FIG. 9 shows a magnified detail of the section depicted in the previous figure.

Finally, FIGS. 8 and 9 show an example of how to obtain a piece of a brass instrument, like a trumpet which, in the specific case represented, is a bell (26), starting with a helical rolling of a metallic filament (27) with a circular section, as in the case of the figures, or any other configuration. The spires obtained by such rolling are homogeneous and they can be used as a mould to perform such rolling, either mechanically or manually.

Any suitable raw material, including precious metals, can be used as raw material.

After shaping the base body (26) by means of the filament rolling (27), it must be stabilized by means of one of the following two alternative solutions:

1. The spires (27) are definitively fixed by means of heat, either through any kind of welding or by pressure. This way, adjacent spires are united and the filament will form a solid element, ready to be incorporated, after the relevant treatment, to the respective musical instrument.

2. The spires (27) can be fixed by means of an electrolytic dip where the base element is introduced, so that it receives a layer (28) which coats and connects the spires, which can be fixed only to the outer face, as in the practical case shown in FIGS. 8 and 9. In this case, the body is introduced into the dip with the inner surface concealed by the shaping mould. On the other hand, the coating can affect both sides, when the base element is introduced into the eletrolitic bath duly isolated.

The element obtained after the electrolytic process, as in the previous case, can also be incorporated into the music instrument foreseen, after it has received the adequate handling.

I claim:

1. In a brass instrument comprising a mouthpiece connected by a pipe to a valved body which is in turn connected to an output bending and a bell thereby defining an air duct, the improvement wherein the bell and the output bending are formed of separate and detachable parts, the brass instrument comprising an intermediate section between the output bending and the bell and coupling means for detachably coupling the intermediate section to the output bending and to the bell respectively, wherein the intermediate section comprises a plurality of subsections in telescopic relation to one another and means for adjusting an overlap between the plurality of telescopic subsections so as to change a length of the intermediate section whereby to alter a tone of the instrument.

2. A brass instrument as claimed in claim 1 wherein the output bending is telescopically coupled to the intermediate section.

3. A brass instrument as claimed in claim 1 wherein the means for adjusting comprises a rod having one end in operable connection to an external key and having another end operably connected to a first of the plurality of telescopic subsections so that a turning motion of the rod causes a movement of the first telescopic subsection relative to a second of the telescopic subsections which results in a change in the length of the intermediate section.

4. A brass instrument as claimed in claim 3 wherein the rod comprises a spring disposed between an inner end of the key and a stop of the second telescopic subsection.

5. A brass instrument as claimed in claim 1 wherein the mouthpiece is formed by three independent elements coupled together, said independent elements consisting of an output cone, a separate bowl and a ring, the output cone comprising an inner bowl of frusto-conical shape and having surface means for accommodating bowls of different length, the separate bowl having a surface that can be accommodated within the surface means such that the separate bowl fits within the inner bowl, said ring having an outer edge defining an internal recess, said separate bowl fitting between the output cone and the ring with an edge of the output cone fitting within the internal recess.

* * * * *